United States Patent [19]

Capolupo

[11] 4,422,964

[45] Dec. 27, 1983

[54] RADIOACTIVE WASTE CONTAINER WITH IMMOBILIZATION COMPARTMENT AND METHOD

[75] Inventor: Richard E. Capolupo, Salisbury, Mass.

[73] Assignee: Capolupo & Gundal, Inc., Salisburg, Mass.

[21] Appl. No.: 325,683

[22] Filed: Nov. 30, 1981

[51] Int. Cl.[3] ..... G21F 9/16

[52] U.S. Cl. ..... 252/628; 250/506.1; 250/507.1; 252/631; 252/633

[58] Field of Search ..... 252/631, 626, 633; 250/506.1, 507.1

[56] References Cited

U.S. PATENT DOCUMENTS

| | | | |
|---|---|---|---|
| 2,743,230 | 4/1956 | Meyer | 210/24 |
| 2,751,347 | 6/1956 | Miller | 210/24 |
| 2,863,830 | 9/1945 | Schneider et al. | 210/41 |
| 2,956,682 | 10/1960 | Stephan | 210/281 |
| 3,116,767 | 1/1964 | Blin et al. | 250/506.1 |
| 3,405,050 | 6/1964 | Bovard et al. | 204/240 |
| 3,658,179 | 4/1972 | Baumann et al. | 210/66 |
| 3,749,917 | 7/1973 | Kucherer | 252/628 |
| 3,883,441 | 5/1975 | Murphy et al. | 252/628 |
| 3,951,811 | 4/1976 | Casolo et al. | 210/281 |
| 4,058,479 | 11/1977 | White et al. | 252/631 |
| 4,107,044 | 8/1978 | Levendusky | 210/266 |
| 4,174,293 | 11/1979 | Colombo et al. | 264/0.5 |
| 4,178,249 | 12/1979 | Councill | 210/281 |
| 4,229,300 | 10/1980 | Benes et al. | 252/631 |
| 4,235,739 | 11/1980 | Baatz et al. | 252/628 |
| 4,290,908 | 9/1981 | Horiuchi et al. | 252/631 |
| 4,297,827 | 11/1981 | Allison | 252/633 |

FOREIGN PATENT DOCUMENTS

| | | | |
|---|---|---|---|
| 2637859 | 3/1978 | Fed. Rep. of Germany | 252/628 |
| 2912672 | 10/1980 | Fed. Rep. of Germany | 250/506.1 |
| 147350 | 4/1981 | Fed. Rep. of Germany | 252/631 |
| 2304995 | 11/1976 | France | 252/631 |
| 1215265 | 12/1970 | United Kingdom | 252/626 |
| 2037058 | 7/1980 | United Kingdom | 252/631 |

*Primary Examiner*—Deborah L. Kyle
*Assistant Examiner*—Howard J. Locker
*Attorney, Agent, or Firm*—Thomas Hooker

[57] ABSTRACT

A radioactive waste container having a radioactive waste compartment, a liquid immobilization compartment located below the waste compartment, a drain passage communicating the compartments and a closure for selectively opening and closing the drain passage; and a method of collecting liquid from radioactive waste in the storage compartment.

52 Claims, 5 Drawing Figures

RADIOACTIVE WASTE CONTAINER WITH IMMOBILIZATION COMPARTMENT AND METHOD

The invention relates to an improved radioactive waste container and method whereby liquid from the waste stored within the container is flowed from the waste storage compartment into absorbent material in a liquid immobilization compartment located beneath the storage compartment and to a method of immobilizing liquid released from radioactive waste following loading and sealing of the container.

Levendusky U.S. Pat. No. 4,107,044 discloses a conventional radioactive waste container comprising a single storage compartment filled with demineralizing material with liquid influent and effluent conduits for flowing liquid radioactive waste into the storage compartment above the demineralizing material and drawing liquid out of the bottom of the compartment. The liquid is usually water. Following the flowing of liquid radioactive waste through the demineralizing material, excess liquid from the demineralizing material may be purged from the compartment by continuing to pump liquid from the effluent conduit system. Compressed air may be supplied to the top of the demineralizing material in an attempt to force excess liquid down to the effluent conduit. Despite these efforts, considerable liquid remains trapped in the demineralizing material, primarily due to capillary forces which hold the liquid to the particles of demineralizing material. Conventional purging operations cannot remove this excess liquid.

The trapped excess liquid in the dimeneralizing material is slowly released, seeps down the demineralizing material and collects on the bottom wall of the container in the form of free-standing liquid. The seepage is formed by the breakdown of the mechanical bonds that initially hold the liquid to the particles. This breakdown occurs slowly so that there is a continuous seepage of released liquid down to the bottom of the container, beginning when the demineralizing material is initially drained and continuing for many months. In the conventional container, the seepage collects at the bottom as a pool of free-standing liquid. The liquid is available to flow freely from the compartment in the event the surrounding walls are broken or cracked, thereby releasing radioactive liquid into the environment. Such environmental contamination is undesirable and may violate governmental regulations concerning the use, storage, shipment and burial of radioactive waste containers.

Baatz et al U.S. Pat. No. 4,235,739 teaches a radioactive canister where liquid waste is mixed with hydraulic cement within the canister so that the waste is trapped in the cement upon hardening. The patent emphasizes the importance of confining the radioactive waste in a binder which prevents leakage in the event the canister is broken. Other radioactive waste containers where liquid waste is stored in a binder are shown in U.S. Pat. Nos. 4,058,479; 4,174,293 and 4,290,908.

The radioactive waste container of the present invention includes a storage compartment like that shown in the Levendusky '044 patent with a liquid immobilization compartment beneath the main radioactive waste storage compartment and separated from the main compartment by an inner wall having a drain passage communicating the compartments. The immobilization compartment is filled with a liquid absorbent material. The inner wall is dished and the drain passage is located at the low point on the wall. During loading of the storage compartment with radioactive waste, a closure seals the drainage passage to prevent liquid collecting on the inner wall from flowing into the immobilization compartment. When the storage compartment has been filled with radioactive waste and, if desired, excess liquid is removed from the storage compartment by a purge operation, the drainage passage is opened to permit any liquid seeping down from the stored radioactive waste to the top of the inner wall to flow along the wall and into the immobilization compartment. The dry absorbent material captures the liquid from the storage compartment and stores it in the immobilization compartment in solid form. Free-standing liquid in the container and the possibility of liquid leaks are eliminated.

The radioactive waste container of the invention may be used to store radioactive waste other than demineralizing material with trapped radioactive ions. For instance, solid waste having a liquid constituent may be stored within the container so that free liquid within the waste flows down to the inner wall, along the wall and into the immobilization compartment where it is absorbed into the dry material in the immobilization compartment.

Other objects and features of the invention will become apparent as the description proceeds, especially when taken in conjunction with the accompanying drawings illustrating the invention, of which there are three sheets and two embodiments.

IN THE DRAWINGS

Figure 1:
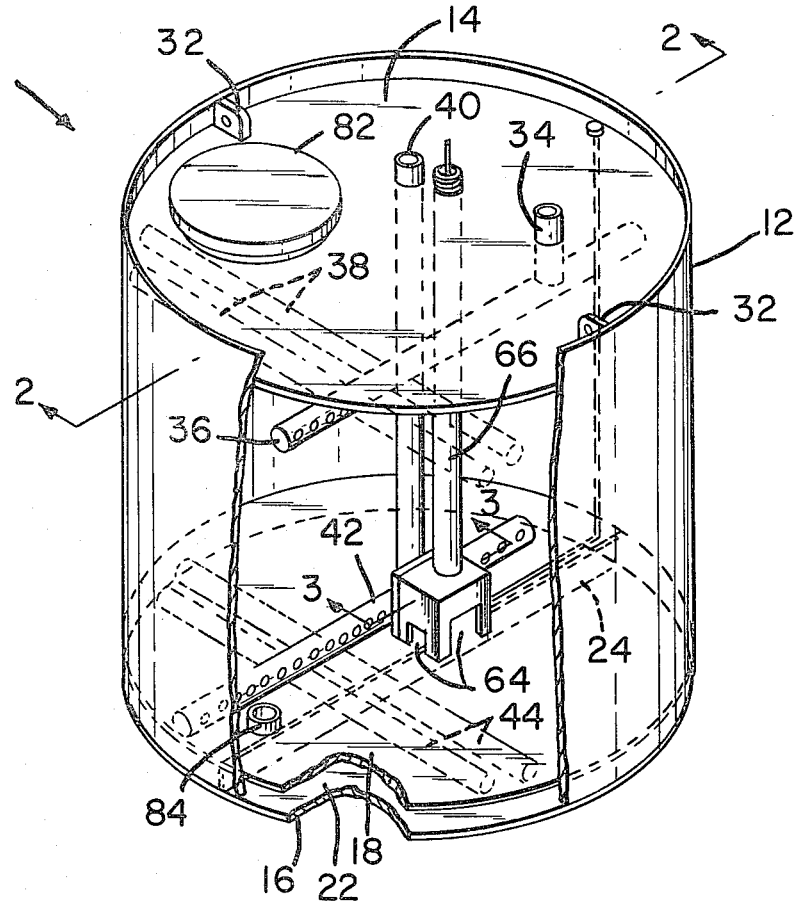
FIG. 1 is a perspective view, partially broken away, of a radioactive waste container according to the invention.
Figure 2:
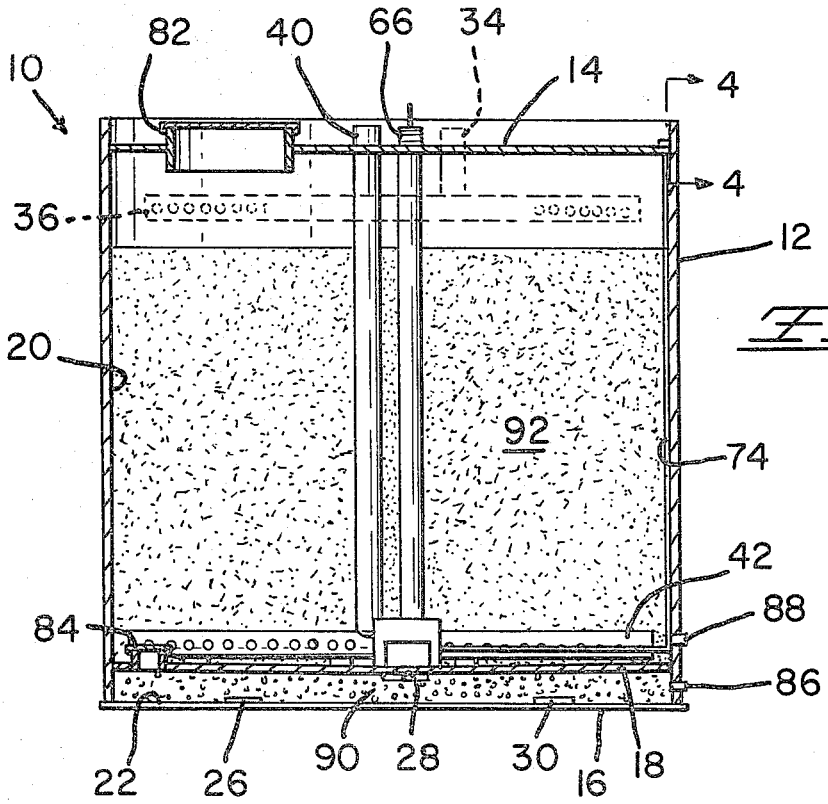
FIG. 2 is a sectional view taken along line 2—2 of FIG. 1.

Referring to FIGS. 1 through 4, radioactive waste container 10 is formed from a steel body having a cylindrical side wall 12 and circular top wall 14 and bottom wall 16. Circular interior wall 18 is located a short distance above the bottom wall 16 to divide the interior of container 10 into a relatively large volume storage compartment 20 and a smaller volume solid waste liquid immobilization compartment 22. A vertical support or gusset plate 24 extends across the diameter of container 10 between walls 16 and 18 to support the interior wall. Liquid distribution cutouts 26, 28 and 30 are provided in plate 44. The joints between the side, top, bottom and interior walls are leak-proof to assure compartments 20 and 22 are liquid and gas-tight. Lifting eyes 32 may be provided at the top of the container.

A radioactive waste influent pipe 34 extends through the top wall 14 to a manifold pipe 36 extending across the top of the storage compartment 20 adjacent the top wall. A series of influent dispersion lines 38, indicated generally, extend to either side of manifold 36 to the side wall. The dispersion lines include a series of spaced outlets so that liquid radioactive waste flowed into pipe 34 is essentially uniformly distributed into the top of compartment 20.

Effluent pipe 40 extends through top wall 14 down through compartment 20 to a manifold 42 located slightly above the interior wall. A plurality of drain lines 44 extend to either side of manifold 42 and include drainage openings located essentially uniformly across the bottom of the compartment 20. Conventional filters may be provided on lines 44 to prevent drawing solids from chamber 20 into the effluent pipe. The exposed ends of the influent and effluent pipes 34 and 40 are provided with conventional couplings to enable them to be attached to a radioactive liquid circulation system or sealed as desired.

Figure 3:
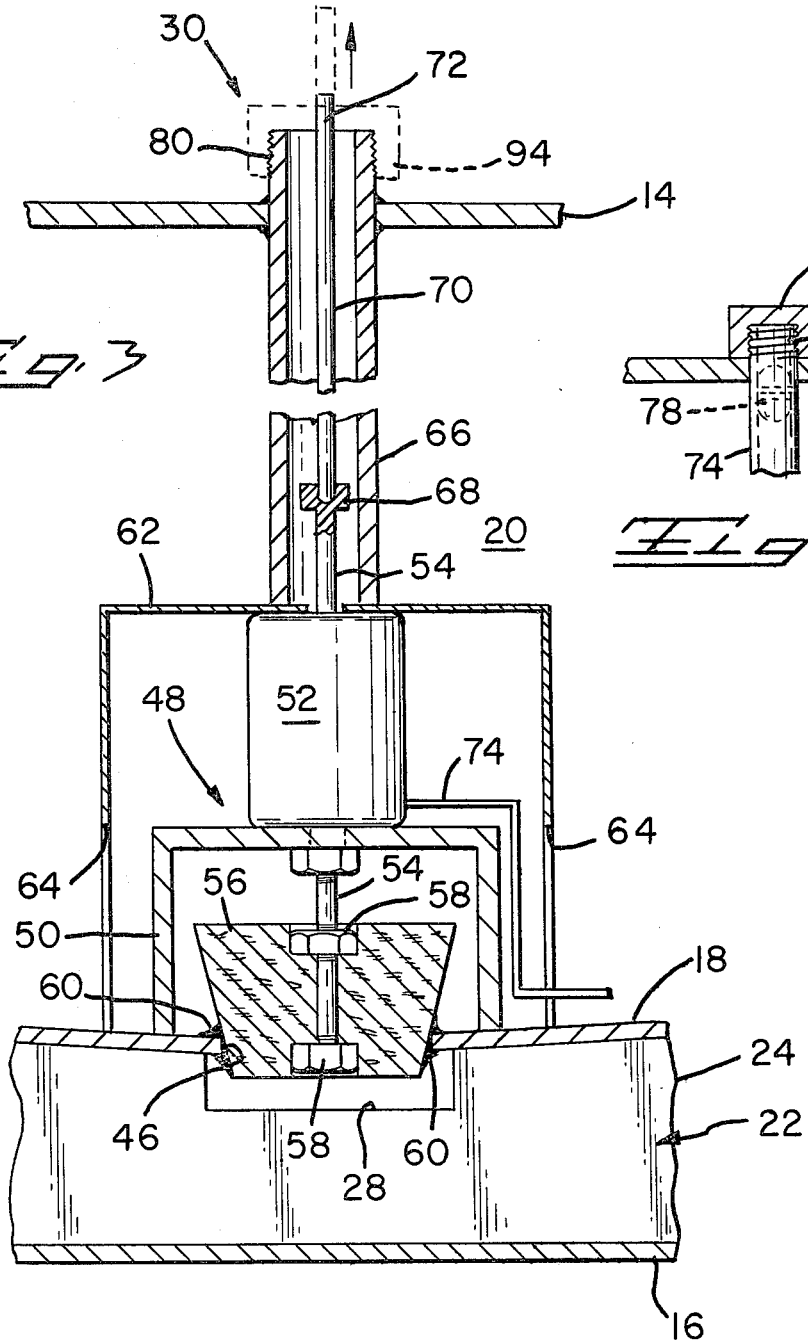
FIG. 3 is an enlarged sectional view, partially broken away, taken along line 3—3 in FIG. 1.
Figure 4:
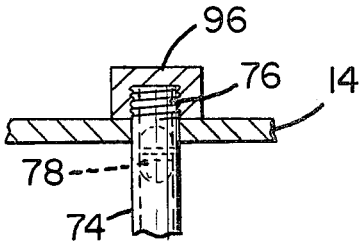
FIG. 4 is a sectional view taken along line 4—4 of FIG. 2.

The interior wall 18 separating compartments 20 and 22 is concave having a low point at a central drain passage 46 shown in FIG. 3. Gravity flows liquid in compartment 20 down to wall 18 and along the wall 18 to the drain. The container 10 includes the closure unit 48 operable to plug a drain 46. The unit 48 includes a U-shaped support bracket 50 mounted on the upper surface of wall 18 and extending over the drain 46. Air cylinder 52 is mounted on the top of the bracket above the drain 46 and includes a piston rod 54 having a lower end extending through a central bore formed in resilient frustoconical stopper 56 seated in the drain 46 to close the passage and prevent the flow of liquid from compartment 20 to compartment 22. Nuts 58 threaded on the lower end of piston rod 54 cooperate to secure the stopper to the rod. A liquid sealer 60 may be applied to stopper 56 prior to initial insertion into drain 46 to guarantee a liquidtight seal between the compartments. Cutout 28 in plate 24 is located beneath drain 46 so that the plate does not prevent the stopper from forming a tight seal in the drain 46. The cutouts 26, 28 and 30 in plate 24 assure that liquid flowing from compartment 20 through passage 46 and into compartment 22 is distributed to either side of the plate.

A box-like cover 62 extends upwardly from the plate 18 to surround and protect the air cylinder and stopper. Drainage openings 64 are provided in cover 62 at the interior wall to permit liquid on the wall to flow to the drain.

Pipe 66 extends from the top of cover 62 through top wall 14 and has a threaded end projecting a short distance above the top wall. The upper end of piston rod 54 extends into the lower end of pipe 66 and carries a rod socket 68 on its free end. Indicating rod 70 is positioned in pipe 66 with its lower end seated in socket 68. When stopper 56 closes drain opening 46, the upper end 72 of rod 70 is located a short distance above the upper end of pipe 66.

Valve air line 74 extends from valve 52 along interior wall 18 to the side of the container and then up the side wall 12 and through the top wall 14 to a threaded end 76 on the outside of top wall 14. A releasable check valve 78 is provided in the line at end 76. Line 74 is connected to a port of cylinder 52 such that pressurization of the line flows pressure fluid past the check valve and shifts the cylinder 52 to raise the piston rod 54. Air cylinder 52 includes a second port (not illustrated) which vents directly to the interior of the pipe 66. The lower end of pipe 66 is sealed to valve 52 to prevent leakage into the pipe. When the air cylinder is in the retracted position and stopper 56 is above opening 46, indicating rod 70 may be removed from the pipe and the free end 80 of the pipe 66 may be connected to a pressure line such that pressure fluid is flowed through the pipe to the cylinder 52 to extend the piston rod 54 and force stopper 56 into the drain passage 46, thereby preventing liquid from flowing from compartments 20 and 22.

A capped, filling opening 82 is provided in top wall 14 and a capped, filling opening 84 is provided on interior wall 18 above the plate 24. Drain plugs 86 and 88 are provided in side wall 12 to permit drainage of excess liquid from compartments 22 and 20. Prior to capping of openings 82 and 84, the liquid immobilization compartment 22 is completely filled with a liquid absorbent material 90, such as vermiculite. Following filling of compartment 22, opening 84 is capped and the storage compartment 20 is filled with an appropriate demineralizing material 92. Material 92 may be an ion exchange resin. The opening 82 is capped after compartment 20 is filled to a level indicated in FIG. 2. Stopper 56 is in the position illustrated in FIG. 3 during the filling of compartments 20 and 22.

Container 10 is used to remove both dissolved and undissolved radioactive impurities from waste liquid. The liquid may be formed as a by-product at nuclear power generating plants, nuclear experimental facilities and other nuclear engineering facilities. In most cases, the radioactive waste is carried in water.

In order to treat the radioactive liquid, a source of the liquid is connected to the exposed end of influent pipe 34 and the exposed end of effluent pipe 40 is connected to a pump for withdrawing purified liquid from the container. During the purification operation, stopper 56 seals drain passage 46.

Liquid containing dissolved and undissolved radioactive waste is pumped through influent pipe 34 and distributed over the top of the demineralizing material 92 within compartment 20. As liquid flows down through the bed of demineralizing material, dissolved radioactive ions are captured by the demineralizing material and thereby trapped within container 10. Liquid reaching the bottom of the column of demineralizing material 92 is pumped from the container through drain lines 44, manifold 42 and effluent pipe 40. The filters surrounding the drain openings in the lines 42 trap any solid radioactive contaminants which may be drawn down through the demineralizing material.

Following completion of the treatment of the radioactive liquid, an immediate attempt is made to purge the chamber 20 of excess remaining liquid. Conventionally, a number of purge techniques are used. One technique is to continue to pump gas and liquid from effluent pipe 40 after the supply of waste liquid to influent pipe 34 has been shut off. In this way, liquid which initially collects at the bottom of the chamber is removed.

During the demineralizing operation, the column of demineralizing material 92 is saturated with liquid. Capillary pressure holds an appreciable part of this liquid within the column. The trapped liquid slowly seeps to the bottom of the compartment. Because the liquid collects slowly at the bottom of the compartment, some purging operations include a step of deactivating the pump for periods of time to allow additional liquid to collect at the bottom of the compartment. After a sufficient liquid collection interval, the pump is reactivated to withdraw the newly collected liquid and then deactivated to allow more liquid to collect.

Purging may be conducted by running the purge pump continuously. Further, in some situations, the influent pipe 34 may be connected to a source of compressed air such that the air is forced down through the demineralizing material in an attempt to force trapped liquid to the bottom of the compartment for removal.

None of the purge systems is successful in removing all of the liquid trapped in the demineralizing material. After the purging operation has been completed, this trapped liquid continues to seep down the demineralizing material and collects on the interior wall 18.

After completion of the purge operation, the end 76 of valve air line 74 is connected to a source of compressed air to pressurize air cylinder 52, raise stopper 56 and open drain 46. After the drain is opened, liquid released from the demineralizing material 92 collects on the inner wall 18, flows to the low point at drain 46 and through the drain opening into the liquid immobilization compartment where the liquid is absorbed in material 90.

Shifting of cylinder rod 54 raises the free end 72 of rod 70 to provide an indication that the stopper has been withdrawn from the opening 46. Rod 70 is then withdrawn from the pipe 76 and a cap 94 secured on the pipe end 80. After the valve is shifted, cap 96 is secured to the end 76 of air line 74. The upper ends of influent and effluent pipes 34 and 40 are capped upon completion of the purge operation. With the capping of the various pipes, chamber 10 is sealed and in position to be placed in a permanent storage site. If desired, the container or the contents of the storage compartment may be cast within concrete or other suitable material to provide a radioactivity shield. Liquid seeping from solidified radioactive waste within the storage compartment flows into the immobilization compartment and is trapped therein as described.

During storage of the container 10, the mechanical forces holding liquid within the demineralizing material 92 continue to break down and release liquid which flows down to wall 18, along the wall and through passage 46 into the immobilization chamber 22 where it is absorbed into material 90. In a radioactive waste container similar to container 10 having a storage compartment of about six feet in height and six feet in diameter, within six months of a full purge, as much as 26 gallons of liquid may be liberated from the demineralizing material column and collected on the storage compartment bottom wall as free-standing liquid.

With the present invention, liquid released from the demineralizing material after purge is flowed to the immobilization compartment where it is absorbed within material 90. The newly released liquid cannot collect as free-standing liquid. The compartment contains sufficient absorbent material to collect water released from the material 92 following purge. Free-standing liquid is eliminated from within the container 10. Accidental rupture of the container will not release potentially radioactive liquid.

If desired, air cylinder 52 may be extended to reseat stopper 56 within opening 46 to re-separate the two compartments 20 and 22. This is accomplished by unscrewing caps 94 and 96, releasing valve 78 and pressurizing the interior of pipe 66. Closing of opening 46 may be desirable in the event either or both drain plugs 86 or 88 is removed to check the condition of the compartments.

Figure 5:
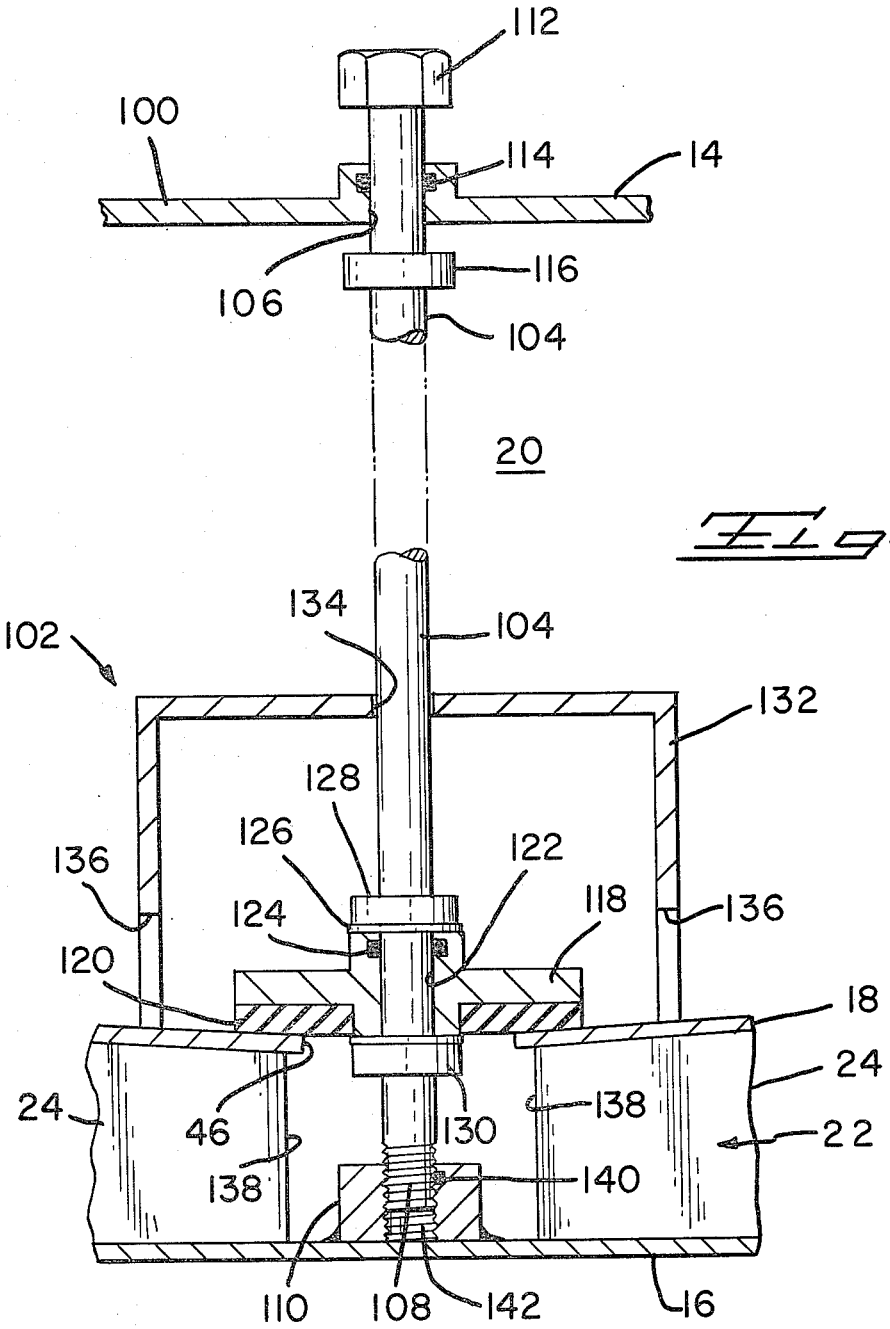
FIG. 5 is a view similar to that of FIG. 3 illustrating a second embodiment of the invention.

FIG. 5 illustrates a second embodiment of the invention where radioactive waste container 100 includes a closure unit 102 for opening and closing the drain opening connecting the storage and immobilization compartments different from the closure unit 48 of container 10. In other respects, container 100 is like container 10. In describing container 100, features common with container 10 will be identified by reference numbers used in FIGS. 1 through 4.

Closure unit 102 includes a closure shaft 104 extending from the bottom wall 16 up through compartment 22, opening 46, compartment 20 and a bore 106 formed in the top wall 14. The lower end of shaft 104 carries threads 108 which engage the interior threads of block 110 secured to the bottom plate 16 below the center of passage 46. The upper end of shaft 104 extends outwardly of the container 100 and is provided with a hexhead 12 for engagement with a rotary drive tool. Alternatively, a rotatable handle may be provided on the upper end of the shaft. Rotary seal 114 is carried on wall 14 to permit rotation of the shaft while maintaining a fluid-tight seal between the shaft and the top wall. A top shoulder 116 is provided on the shaft a short distance below the interior of wall 14 to limit upward movement of the shaft.

Closure plate 118 overlies passage 46. A resilient seal 120 is secured to lower surface of plate 118. The seal extends around the passage 46 for sealing engagement with an interior wall 18 around the passage. Shaft 104 extends freely through a bore 122 extending through the plate to permit independent rotation of the shaft. A seal 124 on plate 118 forms a fluid-tight connection between the plate and shaft. Wear washer 126 on shaft 104 is provided between upper shaft shoulder 128 and the top of the plate 118. A lower shaft shoulder 130 is adjacent the lower surface of plate 118. If desired, a cover 132, similar to cover 62, may be mounted on the inner wall 18. Shaft 104 extends freely through an opening 134 at the top of the cover. Drain cutouts 136 are provided in the sides of the cover to permit liquid collecting on wall 18 to drain to opening 46.

The gusset or support plate 24 of container 100 is cut away at edges 138 adjacent drain opening 46 to provide space for the block 110 and for the lower end of shaft 104 to extend into the immobilization compartment 22 for engagement with the block. A resilient thread lock 140 may be provided on the threads of block 110 to prevent unintentional rotation of the shaft in the block.

The container 100 is provided with influent and effluent pipes, manifolds and lines as in container 10. Prior to use, the immobilization chamber 22 is filled with liquid absorbent material 90 and the storage compartment 20 is filled with demineralizing material 92.

FIG. 5 illustrates the closure unit 102 with shaft 104 rotated into block 110 so that the shoulder 128 firmly biases the seal 120 against the wall and forms a fluid-tight seal between the compartments 20 and 22. The seal is formed by rotating head 112 so that the threaded end of the shaft 108 is drawn down into block 110 to lower shoulder 128. Wear washer 126 facilitates rotation of the shoulder 128 with respect to the plate following initial frictional engagement between the seal 120 and wall 18. The shaft 104 is rotated until a torque loading is sensed at head 12, thereby assuring that the desired fluid-tight shield has been formed to close passage 46. When the passage is closed, the lower end 142 of shaft 104 is free of bottom wall 16.

With the compartments 20 and 22 filled as described and closure unit 102 sealing passage 46, liquid radioactive waste may be flowed through the container 100 in the same manner as described in connection with container 10. The storage compartment 20 is then purged of liquid as described. Following the purging operation, the shaft 104 is rotated to move threads 108 out of block 110 so that shoulder 130 lifts plate 118 from wall 18 and opens the drainage passage 46. The shaft is rotated until should 116 is brought up snug against the top wall 14 to increase the torque loading at head 112 and thereby provide a positive indication that the drain 46 has been opened. If desired, the passage may be reclosed by rotating shaft 104 back into block 110.

Containers 10 and 100 are adpated for storage of a column of demineralizing material and are provided with appropriate conduits for the flow of liquid into and out of the container. The liquid immobilization compartments and closure units of these containers are particularly useful for assuring that liquid liberated following purging is absorbed to prevent free-standing liquid within the container. Containers similar to those disclosed with closure units and immobilization compartments may also be used for storage of other types of radioactive waste which may, in time, liberate liquid for absorption within the immobilization compartment in the manner described. For example, general radioactive waste such as paper, rags, sweepings and the like may be permanently stored within a storage compartment 20 of a container similar to containers 10 and 100 but without the influent and effluent systems and the demineralizing material. Depending upon the amount of liquid contained within the radioactive waste, it may be desirable to purge the storage compartment of liquid initially collected on the interior wall 18. For this purpose, a purge system similar to the effluent system of the first embodiment may be provided. Alternatively, the purge may be conducted by removing a drainage plug so that the collected liquid flows through the plug opening and into a container. The container may have to be tipped to achieve complete drainage. Plug drainage is not desired because of the possibility of contamination and spillage.

After loading, sealing and purging of the storage compartment, the drain passage is opened to allow any subsequently collected liquid on the interior wall to gravity flow into the liquid immobilization compartment for absorption into the material in the compartment. Radioactive waste having a low liquid content may be stored in a container as disclosed without a closure unit for preventing liquid flow into the immobilization compartment before permanent sealing of the storage compartment. The absorbent material in the immobilization compartment provides assurance that liquid which seeps down from the stored waste will flow into the immobilization chamber and be converted to solid form.

Containers 10 and 100 are intended for the storage of radioactive waste and are provided with immobilization compartments for trapping free-standing liquid which is released from waste. It is also intended that the invention include containers for storing other types of waste products where undesired free-standing liquid may be released within the interior of the container. Thus, in containers 10 and 100, the storage compartments 20 could be used to store conventional chemical waste. After opening of passage 46, free-standing liquid released from the waste in chamber 20 flows into the immobilization compartment and is absorbed within material 90, as described.

In some situations, the free-standing liquid flowing into the immobilization compartment may be acidic or basic. In this case, the immobilization material may contain a supply of neutralizing material for forming a chemical reaction with the free-standing liquid and neutralizing the liquid. In this way, the integrity of the steel container is increased by eliminating the potential for corrosion. Other chemical agents may be provided within the immobilization compartment, depending upon the type of desired chemical reaction with the free-standing liquid flowing into the immobilization compartment. It may be desirable to include a gas absorbent material in the immobilization compartment for trapping gases liberated within the container. For instance, the gas absorbing material may trap radioactive radon or other radioactive gases formed as a result of the decay of radioactive waste trapped within the container.

The influent and effluent pipes and the demineralizing material 92 do not form part of the invention. If desired, the interior of the storage compartment may be filled with conventional filtering material which traps radioactive waste or other forms of waste mechanically rather than through a chemical ion exchange process. Bulk waste, whether radioactive or chemical may be stored within chamber 20 as desired.

While the containers 10 and 100 shown in the drawings are formed from steel, in some situations it may be desirable to form the containers from other materials such as relatively chemically inert plastic material. Alternatively, the containers may be formed from steel with plastic or suitably coated interior walls.

While I have illustrated and described a preferred embodiment of my invention, it is understood that this is capable of modification, and I therefore do not wish to be limited to the precise details set forth, but desire to avail myself of such changes and alterations as fall within the purview of the following claims.

I claim:

1. A unitary waste storage container including a solid waste storage compartment, a liquid waste storage compartment located below and joined to the solid waste storage compartment, a liquid drainage passage connecting the compartments and a closure extending across the passage to close the passage during filling of the solid waste storage compartment and an operator for moving the closure to a position opening the passage thereafter to permit liquid from the waste in the solid waste storage compartment to drain into the liquid waste storage compartment.

2. A container as in claim 1 wherein the operator includes a closure acutation element on the outside of the container whereby the passage may be opened from the outside of the container.

3. A container as in claim 2 including indicia means located on the outside of the container for indicating whether the passage is opened or closed.

4. A container as in claim 2 wherein the solid waste storage compartment includes a bottom wall having a low point and said passage extends through the wall at the low point.

5. A container as in claim 1 wherein said bottom wall separates the solid and liquid waste storage compartments.

6. A container as in claim 1 including liquid absorbent material in the liquid waste storage compartment.

7. A container as in claim 1 wherein the solid waste compartment includes a bottom wall having a low point and the passage extends through the wall at the low point.

8. A container as in claim 1 wherein the operator extends the closure into the passage to close the passage and withdraws the closure from the passage to open the passage.

9. A container as in claim 1 wherein the operator moves the closure over the end of the passage to close the passage and withdraws the closure from the end of the passage to open the passage.

10. A container as in claim 1 wherein said operator comprises a pressure fluid cylinder and a pressure line extending from one port of the cylinder through a chamber wall to the exterior of the container.

11. A container as in claim 10 including an indicator extending outwardly of the container moveable with the piston rod of said cylinder to indicate whether the passage is open or closed.

12. A container as in claim 11 wherein said indicator comprises a rod moveable with the cylinder piston rod.

13. A container as in claim 12 wherein a second port of said pressure cylinder is connected to a pipe extending from the cylinder to the exterior of the container, the rod being positioned within the pipe.

14. A container as in claim 1 wherein the closure comprises a plate overlying said passage, a closure shaft operatively connected to said plate and extending outwardly of the container, a seal between the shaft and the wall of the container and means for moving the shaft to move the plate toward and away from the passage so as to close and open the passage.

15. A container as in claim 14 including a threaded connection between the shaft and a fixed portion of the container for axially moving the shaft and plate.

16. A container as in claim 14 including a connection between the shaft and plate permitting rotation of the shaft with respect to the plate.

17. A container as in claim 16 wherein an end of the shaft within the container is threaded, and a fixed threaded block on the container, said end being threaded within said block.

18. A container as in claim 17 including a resilient shaft lock at the threaded connection.

19. A container as in claim 14 wherein said plate carries a resilient seal for closing said passage.

20. A container as in claim 14 wherein said shaft includes a shoulder engageable with a fixed part of the container for limiting movement of the plate away from the passage.

21. A container as in claim 1 wherein the compartments and structure defining the passage are formed from a plastic material.

22. A container as in claim 1 wherein the compartments and structure defining the passage are formed from steel.

23. A container as in claim 1 including liquid absorbent material in the liquid waste storage compartment.

24. A container as in claim 1 including chemical neutralizing material in the liquid waste storage compartment.

25. A container as in claim 1 including gas absorbent material in the liquid waste storage compartment.

26. A container as in claim 1 including a common wall separating the compartments, said passage extending through the wall.

27. A container as in claim 26 wherein the wall includes a low point and the passage is at the low point whereby when the passage is open liquid in the waste stored in the solid waste compartment drains down to the wall, along the wall to the low point and through the passage to the liquid storage compartment.

28. A container as in claim 27 including liquid absorbant material in the liquid waste compartment.

29. A unitary waste storage container having a solid waste storage compartment, a liquid waste storage compartment below and joined to the solid waste storage compartment, a common wall separating the compartments, a closable liquid flow passage extending through the wall to communicate the compartments and liquid absorbtion material in the liquid waste storage compartment for immobilizing liquid draining from waste in the solid waste compartment through the passage and into the absorbant material in the liquid waste storage compartment.

30. A container as in claim 29 including closure means for closing the passage when the solid waste storage compartment is filled with waste and operable to open the passage after the solid waste storage compartment is filled with waste.

31. A container as in claim 30 wherein said container includes a bottom wall, said common wall is spaced a short distance above the container bottom wall and including a support plate running across the immobilization compartment beneath the passage.

32. A container as in claim 31 including a cutout in the support plate beneath the passage.

33. A container as in claim 31 including a liquid distribution cutout in said support plate adjacent the bottom wall.

34. A container as in claim 32 including a liquid waste storage compartment filling opening extending through the common wall above said plate and a cover normally sealing said opening.

35. A container as in claim 29 wherein said common wall includes a low point, said passage extending through the wall at the low point.

36. A container as in claim 29 including a closure member for said passage, a drive for moving the closure member away from and toward the passage so as to open and close the passage, said drive including an actuation device for the closure member and an operator for the actuation device, said operator being located on the exterior of the container.

37. A container as in claim 36 wherein said actuation device includes a pressure cylinder for moving the closure member, and a pressure line extending through the wall of the container.

38. A container as in claim 36 wherein the actuation device includes a mechanical drive.

39. A container as in claim 29 including chemical neutralizing material in the liquid waste storage compartment.

40. A container as in claim 29 including gas absorbent material in the liquid waste storage compartment.

41. The method of removing liquid from waste stored in a container having a solid waste storage compartment and a liquid waste storage compartment comprising the steps of:

a. Placing waste containing solid and liquid waste in a solid waste storage compartment in the container while preventing liquid in the waste from flowing into the liquid waste storage compartment.

b. Gravity flowing liquid within the solid waste storage compartment to the bottom of the storage compartment;

c. Draining the liquid on the bottom of the solid waste storage compartment through a passage in the bottom of the solid waste storage compartment into a liquid waste storage compartment in the container located below the solid waste storage compartment; and d. Solidifying the liquid in the liquid waste storage compartment by absorbtion into a carrier within such a compartment.

42. The method of claim 41 including the steps of purging the solid waste storage chamber of free-standing liquid while preventing liquid from flowing through the passage and into the liquid waste storage compartment.

43. The method of claim 41 including the step of reacting the liquid with a chemical in the liquid waste storage compartment.

44. The method of claim 43 including the step of chemically neutralizing the liquid in the liquid waste storage compartment.

45. The method of claim 44 including the step of reacting the liquid with an acidic material in the liquid waste storage compartment.

46. The method of claim 44 including the step of reacting the liquid with a basic material in the liquid waste storage compartment.

47. The method of claim 41 including the step of trapping undesired gases in material in the liquid waste storage compartment.

48. A unitary waste storage container including a solid waste storage compartment, a liquid waste storage compartment located below and joined to the solid waste storage compartment, a liquid impervious wall at the bottom of the solid waste storage compartment and closable means for forming a passage through said wall communicating the two compartments whereby liquid in waste stored in the solid waste storage compartment gravity drains down to the wall and flows through the passage to the liquid waste storage compartment.

49. A container as in claim 48 including liquid absorbant material in the liquid waste storage compartment.

50. A container as in claim 49 wherein said wall includes a low point and said means forms the passage at the low point.

51. A container as in claim 50 wherein said means includes a passage extending through said wall communicating said compartments, a member extending across the passage to close the passage and an operator for moving the member to a position opening the passage.

52. A container as in claim 51 wherein said operator includes an actuation element on the outside of the container whereby the passage may be opened from the outside of the container.

* * * * *